US006981614B2

(12) United States Patent
Niggemyer

(10) Patent No.: US 6,981,614 B2
(45) Date of Patent: Jan. 3, 2006

(54) DISPENSING POUCH

(75) Inventor: F. William Niggemyer, Fremont, OH (US)

(73) Assignee: Decko Products Inc., Sandusky, OH (US)

( * ) Notice: Subject to any disclaimer, the term of this patent is extended or adjusted under 35 U.S.C. 154(b) by 0 days.

(21) Appl. No.: 10/275,017

(22) PCT Filed: Jun. 2, 2001

(86) PCT No.: PCT/US01/17917

§ 371 (c)(1),
(2), (4) Date: Oct. 30, 2002

(87) PCT Pub. No.: WO01/94219

PCT Pub. Date: Dec. 13, 2001

(65) Prior Publication Data

US 2003/0205584 A1 Nov. 6, 2003

Related U.S. Application Data

(60) Provisional application No. 60/209,685, filed on Jun. 6, 2000.

(51) Int. Cl.
*B65D 35/08* (2006.01)

(52) U.S. Cl. ..... 222/107; 222/92; 222/568; 383/104

(58) Field of Classification Search ..... 222/107, 222/92, 95, 567–568, 153.13, 153.07, 105, 222/206, 214–215; 426/115; 215/228; 383/104
See application file for complete search history.

(56) References Cited

U.S. PATENT DOCUMENTS

| | | | | | |
|---|---|---|---|---|---|
| 299,228 | A | * | 5/1884 | Kirsten | 425/191 |
| 2,620,756 | A | * | 12/1952 | Krens | 425/191 |
| 3,801,247 | A | * | 4/1974 | Parrish et al. | 425/191 |
| 3,847,523 | A | | 11/1974 | Parrish et al. | |
| 4,572,386 | A | * | 2/1986 | Marcus | 215/228 |
| 4,961,517 | A | | 10/1990 | Tkac | |
| 5,026,194 | A | * | 6/1991 | Lewis | 401/261 |
| 5,114,044 | A | * | 5/1992 | Spanek, Jr. | 222/94 |
| 5,287,898 | A | | 2/1994 | Falb et al. | |
| 5,350,240 | A | * | 9/1994 | Billman et al. | 383/104 |
| 5,373,965 | A | * | 12/1994 | Halm et al. | 222/92 |
| 5,758,802 | A | * | 6/1998 | Wallays | 222/212 |
| 5,941,642 | A | * | 8/1999 | Darmstadter | 383/207 |
| 5,971,613 | A | * | 10/1999 | Bell | 383/107 |
| 6,153,238 | A | | 11/2000 | Shannon | |
| 6,190,366 | B1 | | 2/2001 | Tani | |
| 6,220,756 | B1 | * | 4/2001 | Darmstadter | 383/207 |
| 6,241,122 | B1 | | 6/2001 | Araki et al. | |
| 6,578,740 | B1 | * | 6/2003 | Hagihara | 222/107 |

* cited by examiner

*Primary Examiner*—Frederick Nicolas
(74) *Attorney, Agent, or Firm*—Fraser Martin Buchanan Miller LLC; James D. Miller

(57) ABSTRACT

An improved dispensing pouch is provided having a flexible and collapsible container consisting of a pair of tapered side walls (14). A nozzle (12) is disposed at the lower end of the flexible container and heat sealed thereto. A removable end cap (26) is preferably snap-fit on to the nozzle and held in place by a retainer ring (30) or a nozzle with integral scaling threads (20). The side walls of the icing container are preferably heat sealed about the perimeter and on to the nozzle to effect a leak-proof container for the contents contained within.

15 Claims, 6 Drawing Sheets

DISPENSING POUCH

CROSS-REFERENCE TO RELATED APPLICATION

This application claims the benefit of U.S. Provisional Patent Application Ser. No. 60/209,685, filed Jun. 6, 2000.

TECHNICAL FIELD

The invention relates generally to dispensing devices, and more particularly, to pouches containing a confectionery for use in the application of decorative confectionery for cakes and cookies, for example.

BACKGROUND OF THE INVENTION

Typically, flexible and collapsible dispensing bags of the type utilized for decorating cakes and cookies employ a dispensing bag having a relatively large filling opening at one end through which a flowable confection such as cake icing may be introduced. Typical dispensing bags include a relatively small dispensing opening at their other ends. Most prior art containers are substantially tapered from the filling to the discharge end with the lateral confines of the container being constituted of a flexible sheet material which may be formed of a plastic material, or a fabric impregnated with a synthetic resin.

The application of a confectionery to the top of and sides of an iced cake or other pastry is well known in the art. Typically, the confectionery is sufficiently viscous as to maintain its shape and is resistant to excessive flow or slumping after being dispensed from an associated bag. Some types of icing may tend to surface hardened by reason of water evaporation after being dispensed from the bag and, accordingly, it is desirable that pastry bags be substantially leak-proof to prevent hardening of its contents prior to application or leaking during application. Typically, white icings are shipped to retailers who, in turn, color the icing by adding food dye in a variety of different colors. Ordinarily, separate pastry bags are used for each color of icing.

It should be appreciated, such prior art dispensing systems require a baker or decorator to devote a considerable amount of time to mix appropriately colored icing, to fill and clean reusable pastry bags, and clean nozzle tips and other pastry bag accessories. In addition, the steps that need to be taken to dye, fill, and dispense icing from the number of different reusable icing bags results in additional undesirable side effects. For example, the steps of mixing, coloring, icing, and filling bags almost always results in some of the cake decorating material to be deposited at undesirable locations, such as the exterior of the bag, on the work table, and on the user's hands and garments.

SUMMARY OF THE INVENTION

It is a primary object of the present invention to provide a confectionery dispensing pouch that overcomes some of the aforementioned problems encountered by prior art devices.

Another object of the invention is to produce a pouch for dispensing confectionery which allows for improved control of the icing flow to increase artistic capability and sophistication. Still another object of the invention is to produce a confectionery dispensing pouch which provides the same advantages to the home user as the commercial baker.

Additional objects, advantages in other novel features of the invention will be set forth in the description that follows and will become apparent to those skilled in the art upon examination of the following detailed description of a preferred embodiment of the invention.

To achieve the foregoing and other objects, and in accordance with one aspect of the present invention, an improved prefilled confectionery dispensing pouch is provided.

The advantages and objectives of the invention may typically be achieved by a confectionery dispensing pouch which includes a flexible and collapsible container or pastry bag. Preferably, the container bag is formed of one or two sheets of tapered, flexible plastic material sealed together about the periphery to effect a leak-proof seal-of the contents contained therein. A nozzle is provided that is disposed between the narrower portions of the side walls of the dispensing bag and is preferably sealed to complete the leak-proof seal about the periphery of the flexible dispensing pouch. The nozzle preferably includes a number of external threads adapted to receive a retaining ring or decorating tip fitted with corresponding internal threads. A removable end cap is provided that is held in place by the retaining ring.

Still other objects of the present invention will become apparent to those skilled in this art from the following description and drawings wherein there is described and shown a preferred embodiment of this invention in the best mode contemplated for carrying out the invention. As will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The above objects and advantages of the invention will become manifest to those skilled in the art from reading the following detailed description of a preferred embodiments of the invention when considered in the light of the accompanying drawings, in which.

DESCRIPTION OF THE PREFERRED EMBODIMENT

Figure 1:
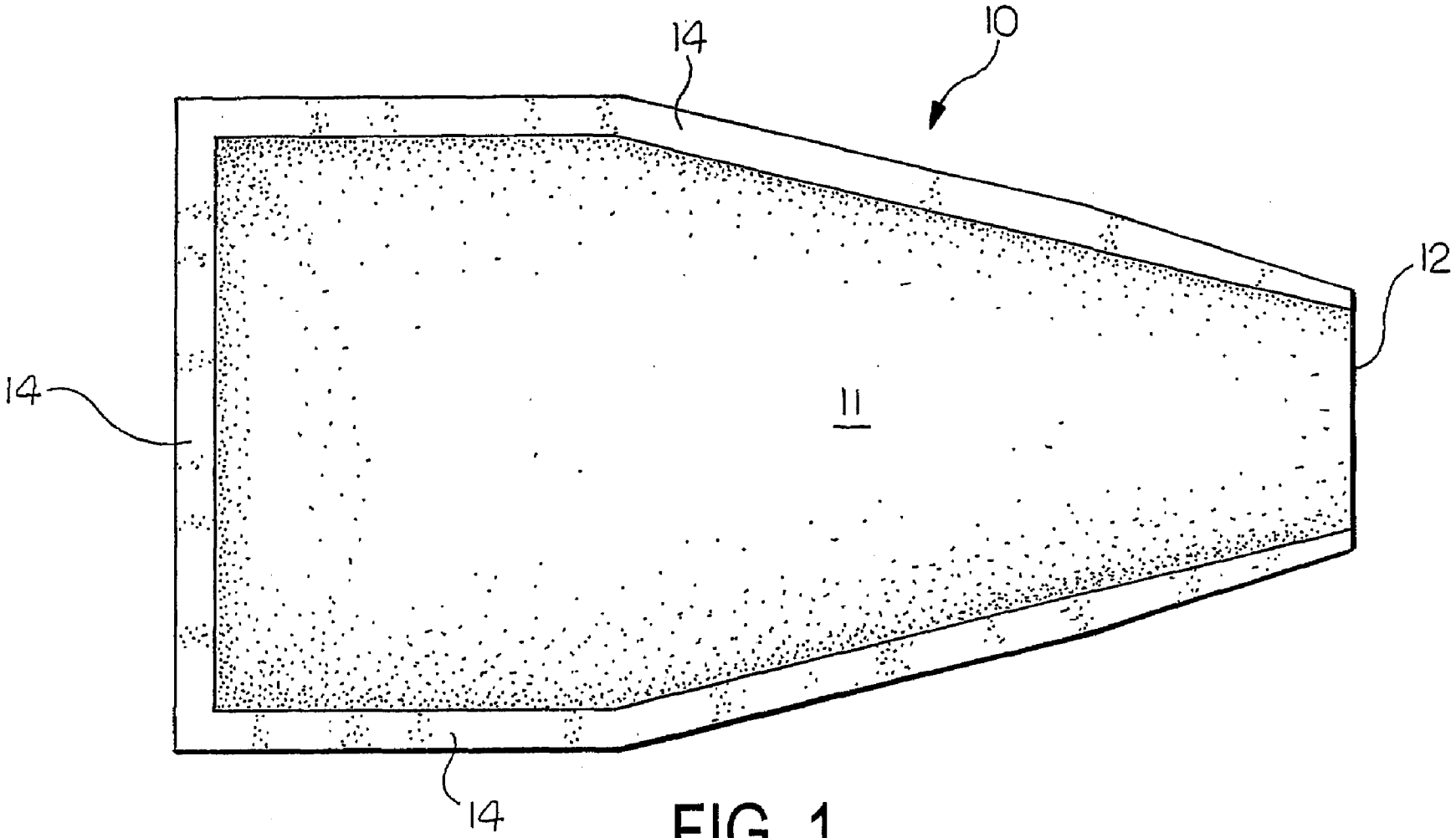
FIG. 1 is a plan view of the dispensing pouch of an embodiment of the present invention.

Reference will now be made in detail to the present preferred embodiment of the preferred embodiment of the invention, an example of which is illustrated in accompanying drawings, wherein like numerals indicate the same elements throughout the views. Referring now to the drawings, FIG. 1 shows the dispensing pouch of the present invention generally designated by the numeral 10. The dispensing pouch is comprised of first and second side walls 11. Each of the side walls 11 includes a top end and a relatively narrow bottom end. The side walls 11 are joined together along the marginal edges at 14, preferably by heat sealing or other suitable means such as by the application of a suitable adhesive, by stitching or sewing or the like to form a flexible and collapsible container for flowable confectionery, for example. The marginal edges 14 of the side walls 11 have a first portion thereof extending from the top end generally towards the bottom end substantially perpendicular to the top end and a second portion thereof sloped with respect to the first portion to facilitate flow of the flowable confectionery towards the narrow bottom end. The flexible container is tapered and is of a generally triangular shape with an outlet opening 12. Preferably, the flexible and collapsible icing container is comprised of a flexible sheet material which may be formed of a synthetic resin or plastic material. Other suitable materials include processed or treated fabric, such as fabric impregnated with a synthetic resin. Any materials that possess the sufficient flexibility and strength and are impervious to the contents to be dispensed would be appropriate forte side walls 11 of the dispensing pouch 10 of the invention.

It will be noted that the peripheral marginal edges 14 of the juxtaposed panels 11 are preferably heat sealed along the two parallel spaced apart edge portions and the top, leaving the outlet portion 12 open.

Figure 2:
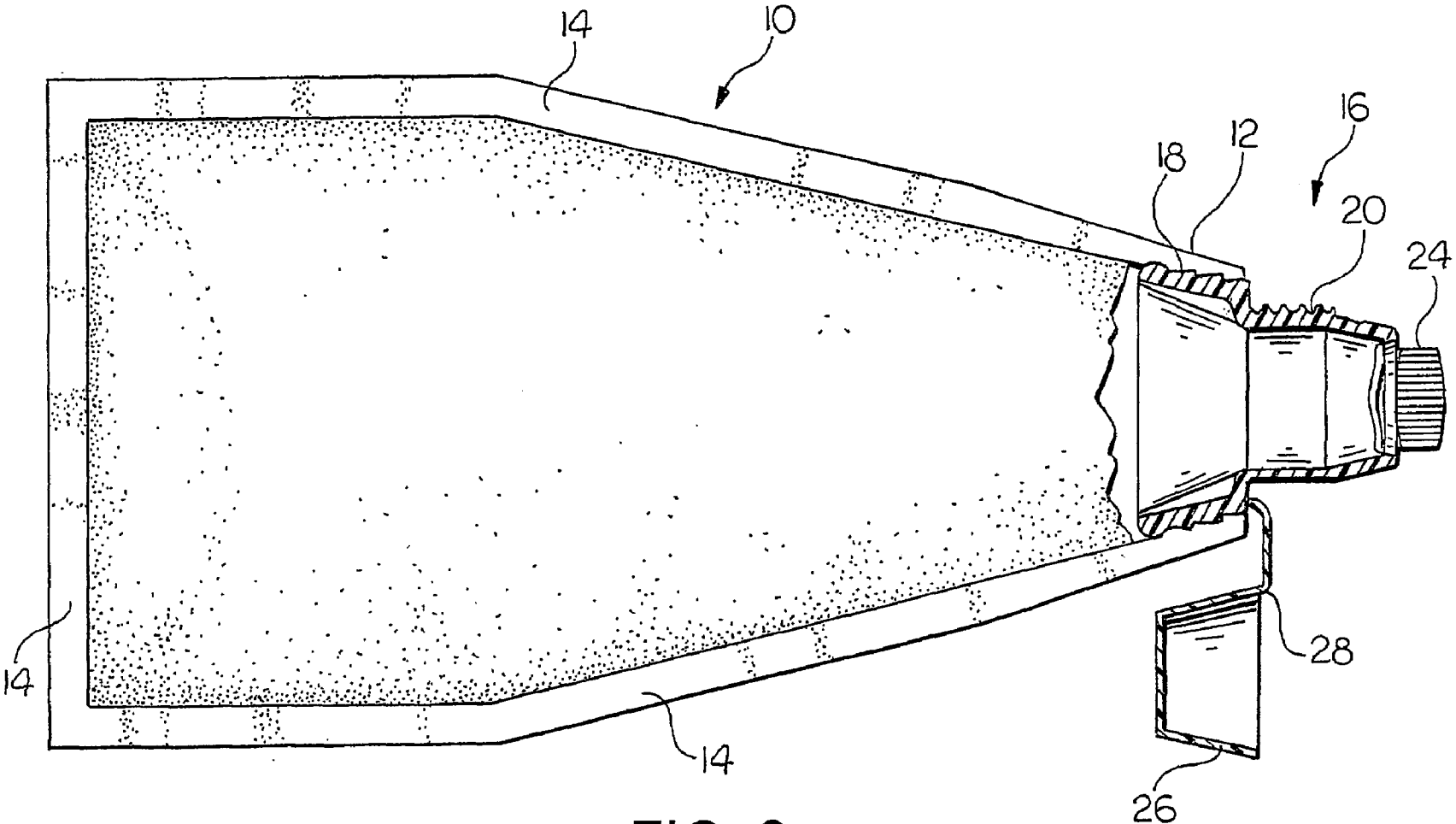
FIG. 2 is a plan view of the dispensing pouch illustrated in FIG. 1 with a dispensing nozzle heat sealed in the outlet of the dispensing pouch.
Figure 3:
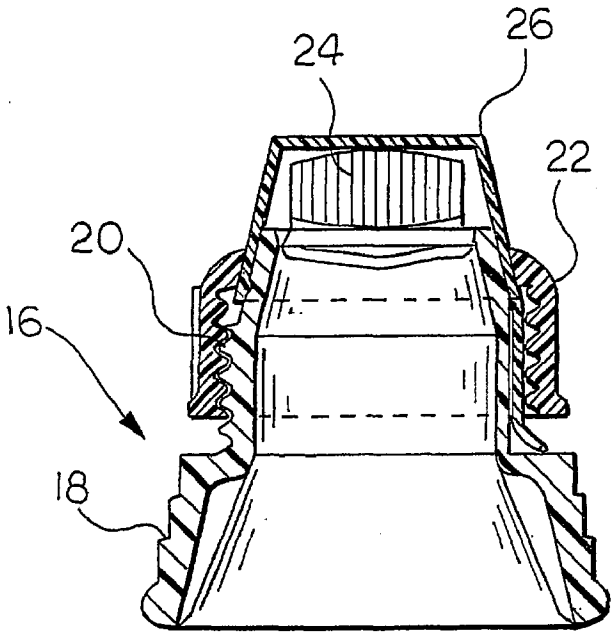
FIG. 3 is an enlarged sectional view of the nozzle illustrated in FIG. 2 prior to the removal of the protective cover.

As clearly illustrated in FIG. 2, the dispensing pouch 10 of the present invention further includes a nozzle assembly 16. The nozzle 16 includes an upper end that is disposed between and joined together with narrow bottom ends of the side walls 11 adjacent the outlet 12. Preferably, the bottom ends of the side walls 11 are heat sealed (or sealed in another appropriate fashion) to the nozzle 16, thereby effecting a leak-proof seal about the periphery of the outlet 12. In such a manner, material stored within the dispensing pouch 10 may be stored and shipped with ease due to the stability of the material therein. The nozzle 16 is provided with a plurality of annular steps 18 which cooperate with the outlet portion 12 of the pouch 10 to produce a heat sealed relationship to occur between the side walls 11 and nozzle 16. The nozzle 16 is also provided with an outer threaded portion 20 to receive the inner threaded portion of an annular retaining ring or collar 22 as illustrated in FIGS. 3, 4, and 5.

A tamper evident tear seal tab 24 is provided on the outermost end of the nozzle 16 to assure the user that the dispensing pouch 10 has not been opened.

A removable end cap 26 is provided that is preferably substantially in the shape of a truncated cone and closed at its top. End cap 26 preferably fits on nozzle 16 in a snap-fit relationship and is secured thereto by a plastic living hinge 28. An internally threaded annular retaining ring 22 may be fit over end cap 26 and about nozzle 16. By twisting the retaining ring 22, the internal threads thereof cooperate with threads 20 on the nozzle 16. Such a configuration allows for the retaining ring 22 to tightly and releasably secure end cap 26 in place during storage and transport of the prefilled dispensing pouch as illustrated in FIG. 3.

Figure 4:
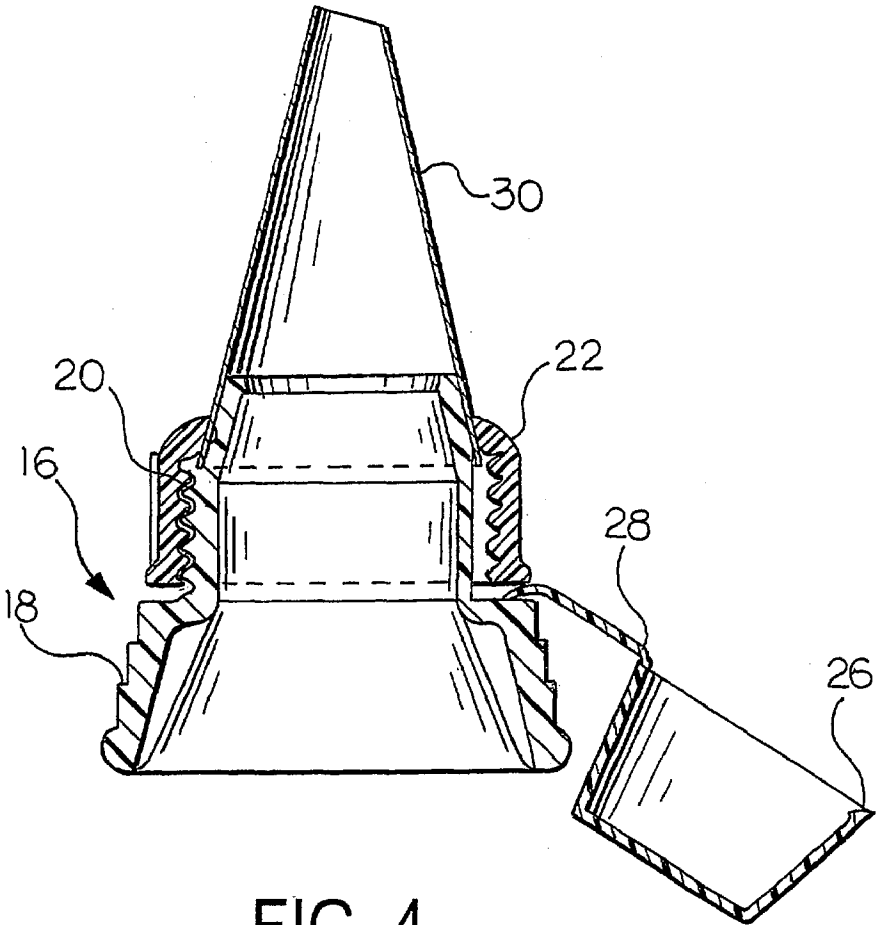
FIG. 4 is an enlarged sectional view of the nozzle illustrated in FIGS. 2 and 3 with a decorative dispensing tip.
Figure 5:
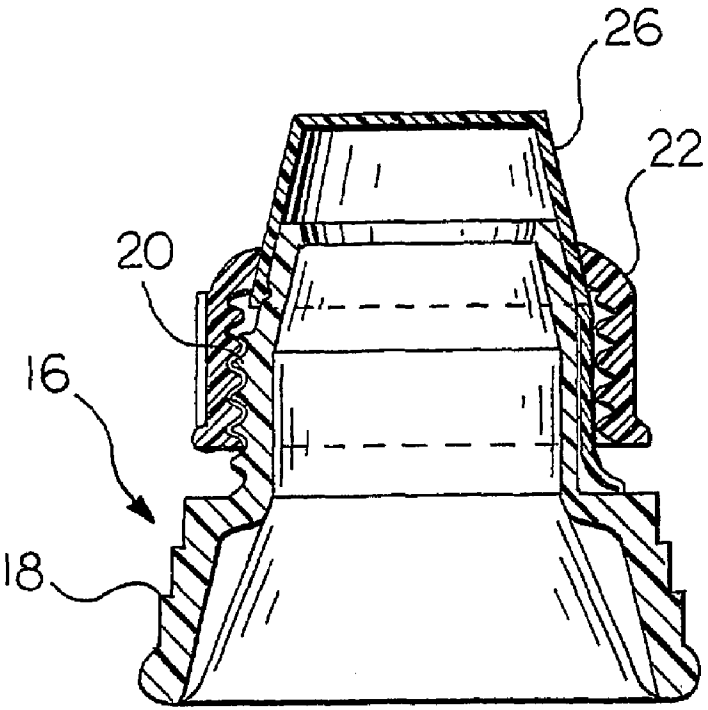
FIG. 5 is an enlarged sectional view of the nozzle illustrated in FIGS. 2, 3, and 4, showing the decorative dispensing tip removed and the protective cap in a resealed position.

With reference to FIG. 4, there is shown a decorator tip 30 positioned on the nozzle 16. The tip 30 is fastened to the nozzle 16 by the retaining ring 22. When an alternative tip is desired, the retaining ring 22 is initially removed by unthreading the same. Once completely loosened from the threads 20 of the nozzle 16, the retaining ring 22 is removed allowing removal and replacement of the tip 30.

When it is desired to reseal the dispensing pouch assembly, the tip 30 is removed, the cover 26 is snapped into a resealing position, and the retaining ring 22 is secured on the threads 20 as illustrated in FIG. 5.

Figure 6:
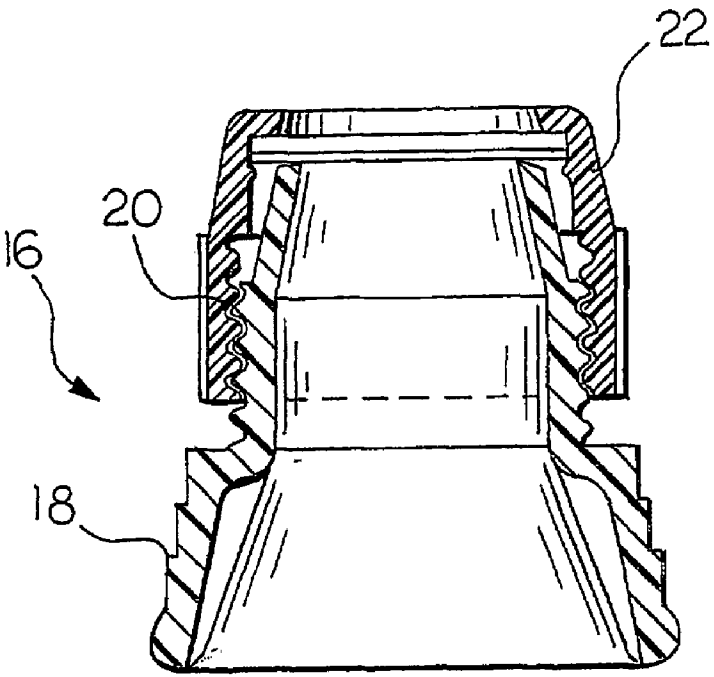
FIG. 6 is an enlarged sectional view of a protective sealing cap arrangement.

FIG. 6 discloses another alternative resealing structure.

Figure 7:
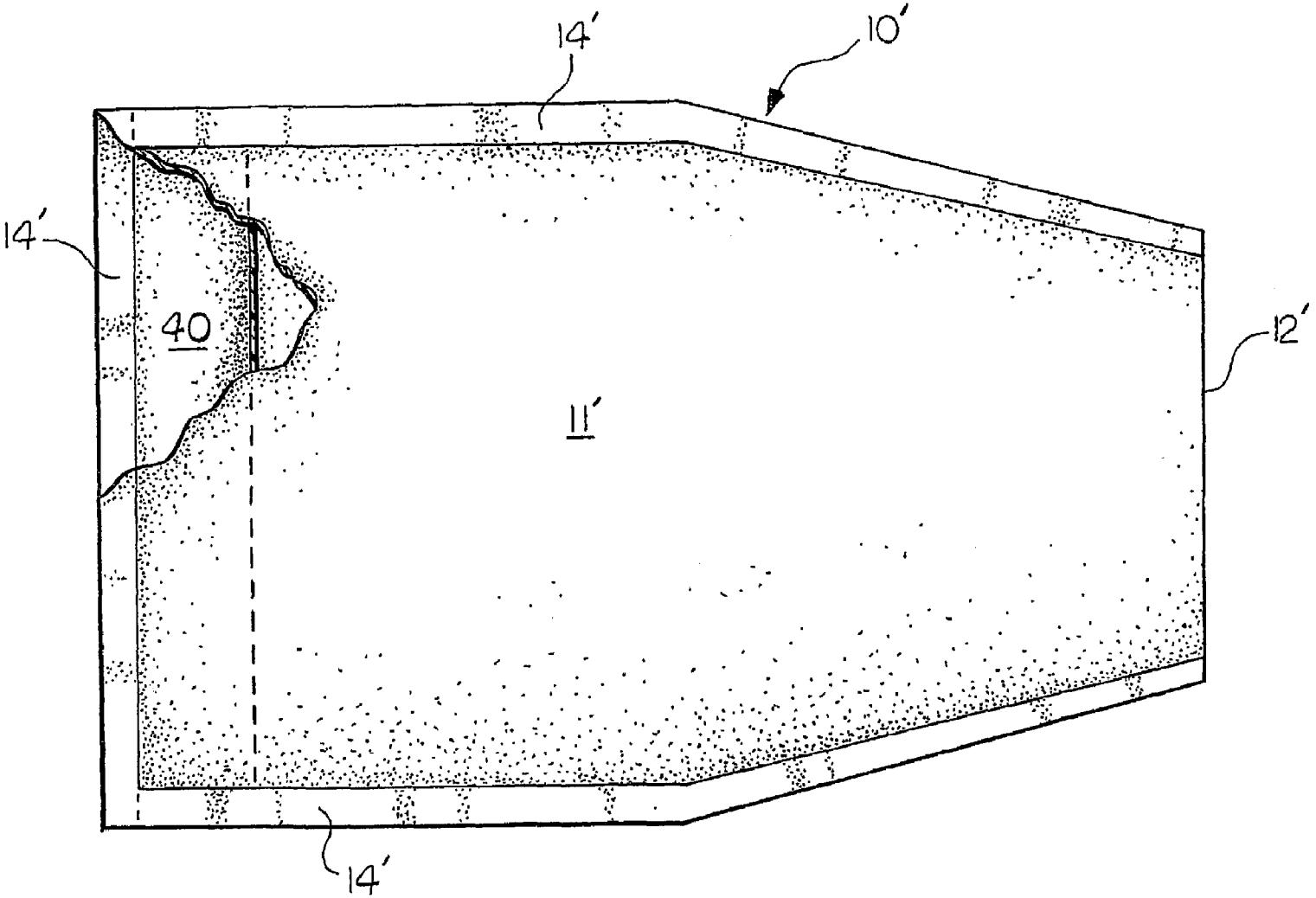
FIG. 7 is a plan view with portions partially cut-away of an alternative dispensing pouch.
Figure 8:
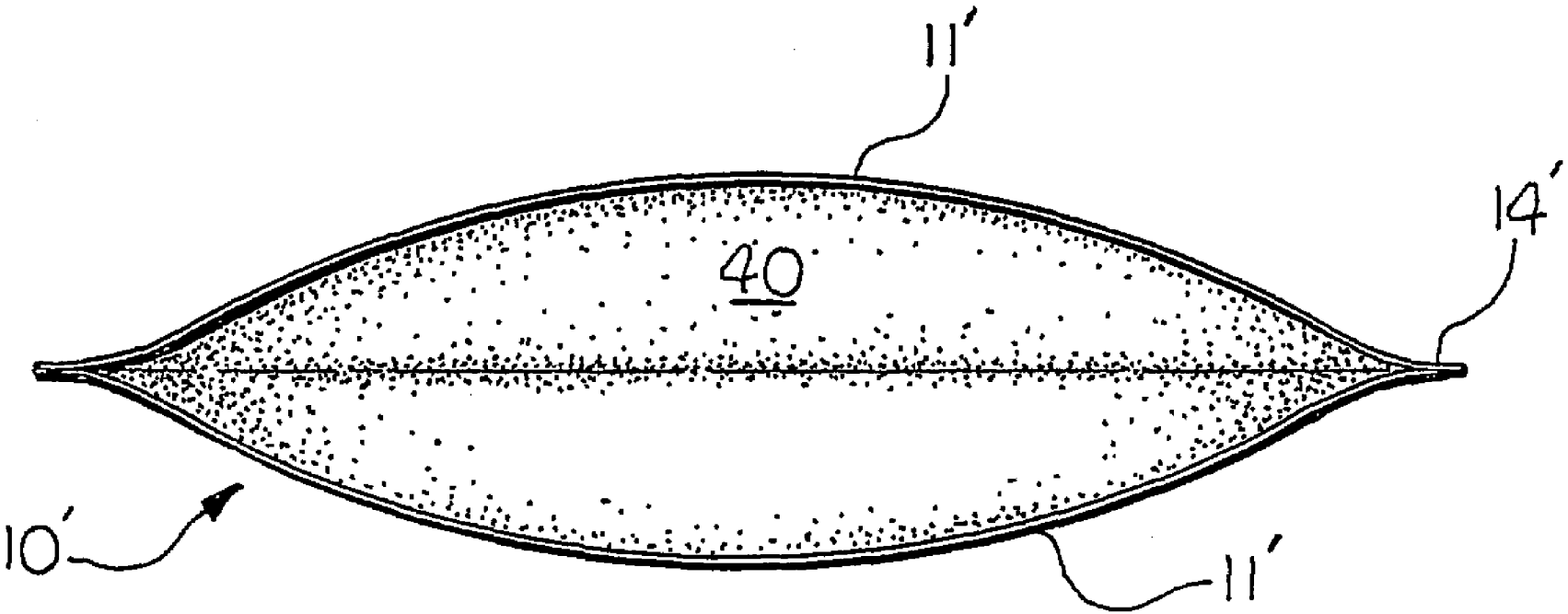
FIG. 8 is a left hand side view of the dispensing pouch illustrated in FIG. 7.

FIGS. 7 and 8 illustrate an alternative type dispensing pouch 10' which may be satisfactorily substituted for the pouch 10 illustrated in FIGS. 1 and 2. More specifically, the dispensing pouch 10' is comprised of first and second side walls 11' which are substantially identical with one another. Each of the side walls 11' includes a top end and a relatively narrow bottom end. The side walls 11' are joined together, preferably along the marginal edges 14', as illustrated in FIG. 7, preferably by heat sealing or other suitable means such as by stitching or sewing or the like to form a flexible and collapsible container for a flowable confectionery, for example. In the dispensing pouch 10', another panel 40 of flexible material has the marginal edges thereof joined to the respective side panels 11' along the respective marginal edges 14' to form a flexible end of the completed pouch.

The flexible container or pouch 10' is tapered and is of a generally triangular shape with an outlet opening 12'. Preferably, the pouch 10' is formed of a flexible sheet material such as a synthetic resin or plastic material impervious to the contents to be dispensed.

The dispensing pouch 10' is typically provided with a nozzle of the same type and applied in the same manner as in the embodiment illustrated in the other illustrations. The structural difference between the embodiments, including the first portion of the marginal edges 14' substantially perpendicular to the end containing the panel 40, enables the embodiment illustrated in FIGS. 7 and 8 to be supported in a stand-up position on the end containing the panel 40.

Unlike prior art dispensing bags, the dispensing pouch of the present invention allows icing to be pre-colored and disposed in the bag before it reaches the retail baker or other user. For example, a manufacturer may distribute a virtually limitless array and variety of colored icing by using the dispensing pouch of the present invention. By so doing, bakers or decorators would no longer be required to undertake the time-consuming and costly task of buying large amounts of white icing in bulk, mixing the icing, filling, using, and cleaning reusable pastry bags, nozzles, etc. The dispensing pouch of the present invention will enable a user to purchase only the colors and amount of icing needed.

In FIGS. 2, 3, and 4 of the invention, the tip 30 and the sealing cap 26 are shown as being secured to the nozzle 16 by an internally threaded retainer ring 22. It will be appreciated that equally viable would be structures wherein the tips or the sealing caps are provided with self-contained threads negating the requirement for a separate attachment ring.

From the above description, it will be appreciated that the present invention may be utilized as a retail package for sale to and used by the homemaker, as well as the bakery department in a retail store or a commercial bakery.

The foregoing description of the preferred embodiment has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the present invention and its practical application to thereby enable one of ordinary skill in the art to best utilize the invention and the various embodiments and with various modifications as are suited to the particular use contemplated.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. A prefilled dispensing pouch comprising:

a flexible and collapsible container, said container comprising first and second side walls and a top panel, each of the side walls comprising a relatively wide top end, a relatively narrow bottom end, and first and second sides, the first and second side walls being joined together along corresponding first sides and corresponding second sides, each of the corresponding first sides and corresponding second sides includes a first portion extending from the top end generally towards the bottom end substantially perpendicular to the top end and a second portion sloped with respect to the first portion, the top panel having marginal edges joined to the first and second side walls along the top end thereof which cooperate with the first portion of the corresponding first sides and corresponding second sides of the side walls to facilitate supporting the dispensing pouch in a stand-up position on the top end of the first and second side walls;

flowable contents disposed within said flexible and collapsible container, the second portion of the corresponding first sides and corresponding second sides of the side walls of said flexible and collapsible container to facilitate flow of said flowable contents to the bottom end when pressure is applied to an outer surface of said container;

a nozzle having one end disposed between and joined together with the narrow bottom ends of the side walls of said container sealing so that said flowable contents are disposed within said container in a leak-proof manner, said nozzle causing said flowable contents to exit said container in a desired shape, the desired shape maintained by said flowable contents after exiting said container;

a removable end cap disposed on the other end of said nozzle; and a retaining ring disposed about said removable end cap.

2. A prefilled dispensing pouch as defined in claim 1 wherein said container is tapered inwardly from the top end to the bottom end.

3. A prefilled dispensing pouch as defined in claim 1 wherein said nozzle includes external threads.

4. A prefilled dispensing pouch as defined in claim 3 wherein said retaining ring includes a plurality of internal threads adapted to receive the external threads of said nozzle to selectively retain said end cap on said nozzle.

5. A prefilled dispensing pouch as defined in claim 1 wherein the top panel is positioned in fluid tight relation between the corresponding ends of the side walls of said container.

6. A prefilled dispensing pouch as defined in claim 1 wherein said flowable contents are a viscous confectionery.

7. A prefilled dispensing pouch as defined in claim 6 wherein the confectionery is icing.

8. A prefilled dispensing pouch as defined in claim 7 wherein the icing is precolored in a desired color.

9. A prefilled dispensing pouch comprising:

a flexible and collapsible container, said container comprising first and second side walls and a top panel, each of the side walls comprising a relatively wide top end, a relatively narrow bottom end, and first and second sides, the first and second side walls being joined together along corresponding first sides and corresponding second sides, each of the corresponding first sides and corresponding second sides includes a first portion extending from the top end generally towards the bottom end substantially perpendicular to the top end and a second portion sloped with respect to the first portion, the top panel having marginal edges joined to the first and second side walls along the top end thereof which cooperate with the first portion of the corresponding first sides and corresponding second sides of the side walls to facilitate supporting the dispensing pouch in a stand-up position on the top end of the first and second side walls;

a viscous confectionery disposed within said flexible and collapsible container, the second portion of the corresponding first sides and corresponding second sides of the side walls of said flexible and collapsible container to facilitate flow of said confectionery to the bottom end;

a nozzle having one end disposed between and joined together with the narrow bottom ends of the side walls of said container so that said confectionery is disposed within said container in a leak-proof manner, said nozzle centrally disposed in the narrow bottom ends of the side walls of said container, said nozzle adapted to receive at least one decorating tip thereon to cause said confectionery to exit said container in a desired shape, the desired shape maintained by said confectionery after exiting said container.

10. A prefilled dispensing pouch as defined in claim 9 wherein said confectionery is icing.

11. A method of storing and dispensing a flowable material, the method comprising the steps of:

providing a flexible and collapsible container comprising first and second side walls and a top panel, each of the side walls comprising a relatively wide top end, a relatively narrow bottom end, and first and second sides, the first and second side walls being joined together along corresponding first sides and corresponding second sides, each of the corresponding first sides and corresponding second sides includes a first portion extending from the top end generally towards the bottom end substantially perpendicular to the top end and a second portion sloped with respect to the first portion, the top panel having marginal edges joined to the first and second side walls along the top end thereof which cooperate with the first portion of the corresponding first sides and corresponding second sides of the side walls to facilitate supporting the container in a stand-up position on the top end of the first and second side walls;

providing flowable contents;

disposing the flowable contents within the container wherein the second portion of the corresponding first sides and corresponding second sides of the side walls of the flexible and collapsible container facilitate flow of the flowable contents to the bottom end when pressure is applied to an outer surface of the container;

providing a nozzle assembly having one end disposed between and joined together with the narrow bottom ends of the side walls of the container so that the flowable contents are disposed within the container in a leak-proof manner, the nozzle causing the flowable contents to exit the container in a desired shape, the desired shape maintained by the flowable contents after exiting the container.

12. A method as defined in claim 11 wherein the flowable contents provided are a viscous confectionery.

13. A method as defined in claim 12 wherein the confectionery provided is icing.

14. A method as defined in claim 13 wherein the icing provided is precolored in a desired color.

15. A method as defined in claim 13 further comprising the step of dispensing the icing on a cake.

* * * * *